US009913554B2

(12) United States Patent
Tiefel et al.

(10) Patent No.: US 9,913,554 B2
(45) Date of Patent: Mar. 13, 2018

(54) TOY MECHANICAL STRAW WITH ACTUATOR DIAPHRAGM

(71) Applicant: Creative Things, LLC, Springdale, AR (US)

(72) Inventors: Simeon E. Tiefel, Springdale, AR (US); Keith Scheffler, Springdale, AR (US)

(73) Assignee: Hog Wild, LLC, Clackamas, OR (US)

( * ) Notice: Subject to any disclaimer, the term of this patent is extended or adjusted under 35 U.S.C. 154(b) by 0 days.

(21) Appl. No.: 14/947,237

(22) Filed: Nov. 20, 2015

(65) Prior Publication Data

US 2016/0143468 A1 May 26, 2016

Related U.S. Application Data

(60) Provisional application No. 62/082,185, filed on Nov. 20, 2014.

(51) Int. Cl.
*A63H 13/00* (2006.01)
*A47G 21/18* (2006.01)

(52) U.S. Cl.
CPC ..... *A47G 21/182* (2013.01); *A47G 21/188* (2013.01)

(58) Field of Classification Search
CPC ..... A47G 21/182; A47G 21/188
USPC ..... 446/71, 72, 199, 200, 201; 239/33
See application file for complete search history.

(56) References Cited

U.S. PATENT DOCUMENTS 250,816 A * 12/1881 Horowitz ..... A63H 5/00 446/200
1,043,514 A * 11/1912 Drexler ..... A63H 29/16 131/178
1,445,362 A * 2/1923 Schwarzkopf ..... A63H 33/40 428/16
2,230,835 A * 2/1941 Graetz ..... A63H 5/00 446/200
2,619,770 A * 12/1952 Dinhofer ..... A47G 21/182 239/211
2,811,808 A 11/1957 Briese
3,122,959 A * 3/1964 Barr ..... A47G 21/182 446/246
3,153,300 A * 10/1964 Keech ..... A63H 11/00 185/37
3,315,405 A * 4/1967 Hoffer ..... A47G 21/182 239/33
3,332,622 A 7/1967 Lombard
3,782,028 A * 1/1974 Kelly ..... A63H 29/14 446/200
3,834,068 A * 9/1974 Fabricant ..... A63H 33/00 446/200

(Continued)

*Primary Examiner* — Melba Bumgarner
*Assistant Examiner* — Joseph B Baldori
(74) *Attorney, Agent, or Firm* — LaMorte & Associates P.C.

(57) ABSTRACT

A novelty straw assembly has a first straw section and a second straw section. Both sections interconnect to a manifold. A diaphragm is coupled to the manifold, wherein the diaphragm expands and contracts with changes in pressure within the manifold. Linkage assemblies are moved by the diaphragm as the diaphragm expands and contracts. A toy with moving parts is mounted between the two straw sections. The moving parts are coupled to the linkage assemblies and are moved by the linkage assemblies as a person drinks through the novelty straw assembly.

11 Claims, 6 Drawing Sheets

(56) References Cited

U.S. PATENT DOCUMENTS 3,879,885 A * 4/1975 Fabricant ..... A63H 33/28 446/202
4,211,024 A * 7/1980 Nickell ..... G09F 23/02 239/33
4,252,273 A 2/1981 Karterman
4,579,281 A * 4/1986 Karterman ..... A47G 21/182 239/33
4,726,518 A * 2/1988 Martina ..... A47G 21/182 239/33
5,361,987 A * 11/1994 Matheussen ..... A47G 21/182 215/388
5,362,385 A * 11/1994 Klegerman ..... C02F 1/002 210/136
6,024,624 A * 2/2000 Lee ..... A47G 21/02 446/202
6,129,292 A 10/2000 Leung et al.
6,142,384 A * 11/2000 Shafik ..... C02F 1/002 210/282
6,579,141 B2 * 6/2003 Bayliss ..... A47G 19/2227 220/707
6,948,664 B2 * 9/2005 Sheedy ..... A47G 21/182 239/24
7,100,838 B1 9/2006 Epstein
7,189,134 B2 * 3/2007 Nugent ..... B65D 47/061 215/230
7,452,092 B2 * 11/2008 Vanderschuit ..... A47G 21/182 362/101
7,874,892 B2 * 1/2011 Hippely ..... A63H 17/006 446/198
2002/0092919 A1 * 7/2002 Campagna ..... A47G 21/188 239/33
2003/0218076 A1 * 11/2003 Farnsworth ..... A47G 19/2227 239/33
2006/0144955 A1 * 7/2006 Farnsworth ..... A47G 21/182 239/33
2013/0231026 A1 * 9/2013 Keungmanivong . A47G 21/182 446/200

* cited by examiner

TOY MECHANICAL STRAW WITH ACTUATOR DIAPHRAGM

RELATED APPLICATIONS

This application claims priority of provisional patent application No. 62/082,185, filed Nov. 20, 2014.

BACKGROUND OF THE INVENTION

1. Field of the Invention

In general, the present invention relates to novelty drinking straws. More particularly, the present invention relates to novelty straws with mechanical elements that are caused to move when liquid is drawn through the straw.

2. Prior Art Description

Drinking straws have been utilized by people throughout recorded history. In this long period of time there have been many inventions that relate to drinking straws. The prior art history is, therefore, replete with references that address different straw designs and styles.

Generally speaking, a drinking straw is a tube having one end that can be placed in a beverage. A person brings the straw to their mouth and draws the beverage into their mouth through the structure of the straw. Since a straw allows a person to drink without having to lift a full cup, drinking straws are often provided to children who have difficulty handling a cup or beverage can without spilling its contents. Since drinking straws are particularly popular with children, straws have often been formed into unusual shapes in order to increase the novelty of the straw and its appeal to a child. For example, drinking straws have commonly been made translucent with multiple turns and loops. A child can then watch the progress of a fluid flowing through the turns of the straw while drinking through the straw.

In a few prior art drinking straw designs, the flow of fluid through the drinking straw is used to cause movement of decorative elements contained within the straw. For instance, in U.S. Pat. No. 4,252,273 to Karterman, entitled Amusement Drinking Straw, a drinking straw is shown having an internal rotor. The rotor rotates within the drinking straw as liquid flows past the rotor. A similar configuration is shown in U.S. Pat. No. 7,100,838 to Epstein, entitled Novelty Straw And Associated Method Of Operation.

Drinking Straws also exist that move novelty items that are external to the straw. In such prior art drinking straws, the flow of liquid through the straw is converted into mechanical energy that is used to move an object that is external to the straw. Such prior art straws are exemplified by U.S. Pat. No. 3,332,622 to Lombard, entitled Drinking Straw, U.S. Pat. No. 2,811,808 to Briese, entitled Drinking Tube, and U.S. Pat. No. 6,129,292 to Leung, entitled Novelty Drinking Straw. With such prior art, the liquid passing through the straw is used directly to create the mechanical motion. As such, the mechanisms within the straws are hydraulic in nature. A problem shared by all such prior art straws is that since the mechanisms are hydraulic, the mechanisms become contaminated by the flowing fluid. Often the flowing fluid is a high-sugar soft drink or chocolate milk. Such fluids leave sugar/cocoa deposits within the straw mechanism that can quickly bind the moving parts.

It will be understood that when a person draws a liquid through a straw, there are other forces available for use besides the hydraulic force of the flowing liquid. To draw a liquid through a drinking straw, a person must first suck on the straw. This reduces the air pressure within the straw. This change in air pressure can be utilized to produce pneumatic work. Mechanisms within a straw that operate using pneumatic forces need not become contaminated with the fluid passing through the straw.

A need therefore exists for a novelty straw design that has moving elements that are caused to move using pneumatic forces, rather than hydraulic forces. This need is met by the present invention as it is described and claimed below.

SUMMARY OF THE INVENTION

The present invention is a novelty straw assembly that utilizes an elastomeric diaphragm to actuate a mechanical movement. Upon a pressure drop or vacuum made by sucking fluid through a straw, the elastomeric diaphragm contracts. This causes a downward physical motion. The motion can be reversed by blowing into the straw and inflating the diaphragm. The movement of the diaphragm is used to move linkage assemblies translates the movements of the diaphragm into the movement of toy parts.

A person can move liquid back and forth in the straw to create a reciprocating motion. A check valve is used to limit flow in one direction and eliminate any undesirable back flow. The check valve is at the base of the straw along with a filter to stop possible particles from rendering the system ineffective. This also prevents a back pressure that may be generated from a person wanting to blow into the straw and overinflate the diaphragm. Such back pressure could pop or damage the diaphragm. Having a fluid restrictor is also needed within the system to increase the load bearing ability of the diaphragm and to allow for more work to be done through the mechanics. This restrictor can be increased or decreased in size based on the work needed.

The novelty straw assembly has a first straw section and a second straw section. Both sections interconnect to a manifold. The diaphragm is coupled to the manifold, wherein the diaphragm expands and contracts with changes in pressure within the manifold. Linkage assemblies are moved by the diaphragm as the diaphragm expands and contracts.

A character or other toy with moving parts is mounted between the two straw sections. The moving parts are coupled to the linkage assemblies and are moved by the linkage assemblies.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention straw assembly can be embodied in many ways, only one exemplary embodiment is illustrated. The illustrated embodiment is selected in order to set forth one of the best modes contemplated for the invention. The illustrated embodiment, however, is merely exemplary and should not be considered a limitation when interpreting the scope of the appended claims.

Figure 1:
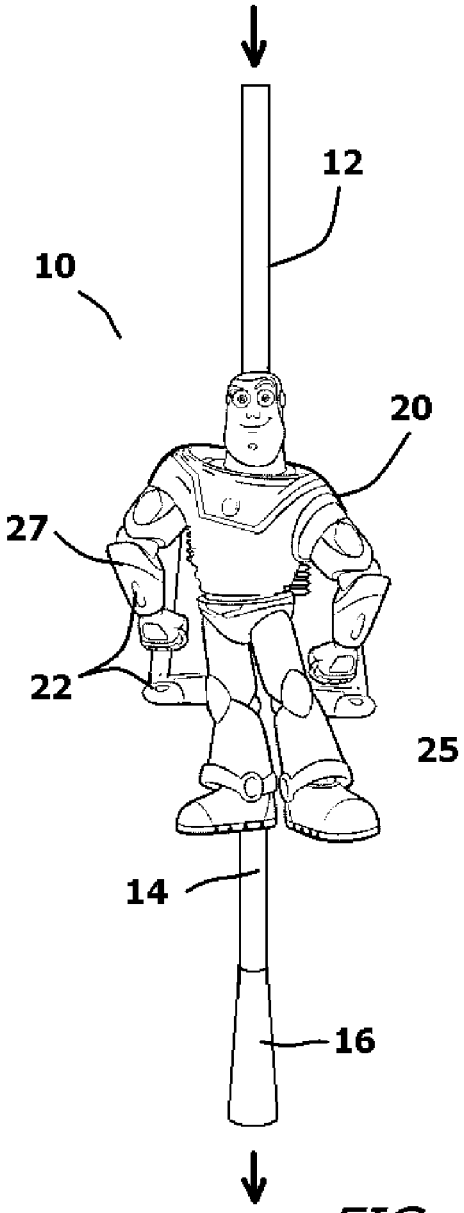
FIG. 1 is a perspective view of an exemplary embodiment of a novelty straw assembly containing an articulated character in a retracted position.
Figure 2:
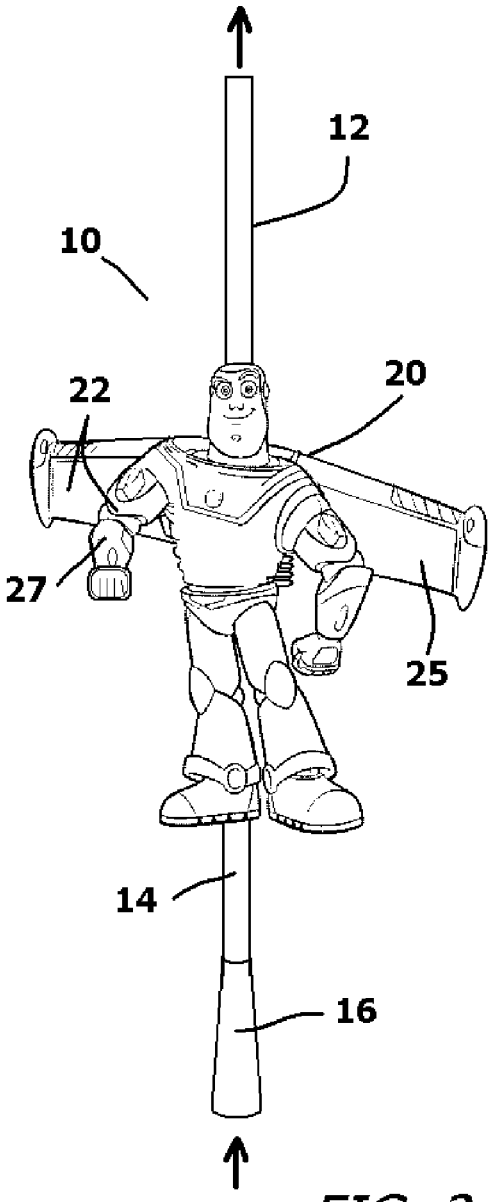
FIG. 2 is a perspective view of an exemplary embodiment of a novelty straw assembly containing an articulated character in an extended position.

Referring to FIG. 1 in conjunction with FIG. 2, a novelty straw assembly 10 is shown. The novelty straw assembly 10 includes an upper straw section 12, a lower straw section 14, an intake head 16, and an articulated character 20. The articulated character 20 is disposed between the upper straw section 12 and the lower straw section 14. The intake head 16 terminates the lower straw section 14 at the lowest part of the novelty straw assembly 10.

The articulated character 20 has moving parts 22. The moving parts 22 are moved by a unique manifold and diaphragm subassembly that is later described in more detail. The manifold and diaphragm subassembly produces movement that depends upon the relative pressure within the upper straw section 12. When the pressure in the upper straw section 12 is greater than ambient pressure, the moving parts 22 of the articulating character 20 are moved into a first configuration. When the pressure within the upper straw section 12 is lower than ambient pressure, the moving parts 22 are moved into a second configuration.

In the exemplary embodiment, the articulated character 20 is configured as the Disney® character Buzz Lightyear®. The moving parts 22 of the articulated character 20 are the wings 25 and the laser arm 27. In the first configuration, the wings 25 and laser arm 27 of the articulated character 20 are down. In the second configuration, the wings 25 and the laser arm 27 of the articulated character 20 are raised. It will therefore be understood that the wings 25 and the laser arm 27 can be raised by selectively sucking through the novelty straw assembly 10 and causing the moving parts 22 to move between the first configuration and the second configuration.

The articulated character 20 shown is exemplary. Most any object can be used as the articulated character 20. The articulated character 20 need not be a humanoid character. For instance, the articulated character 20 can be configured as a flower having pedals that rise and fall, or a toy car having doors that open and close. What is of importance is that the articulated character 20 is interesting to a child and has moving parts that can be readily observed by a child drinking through the novelty straw assembly 10.

Figure 3:
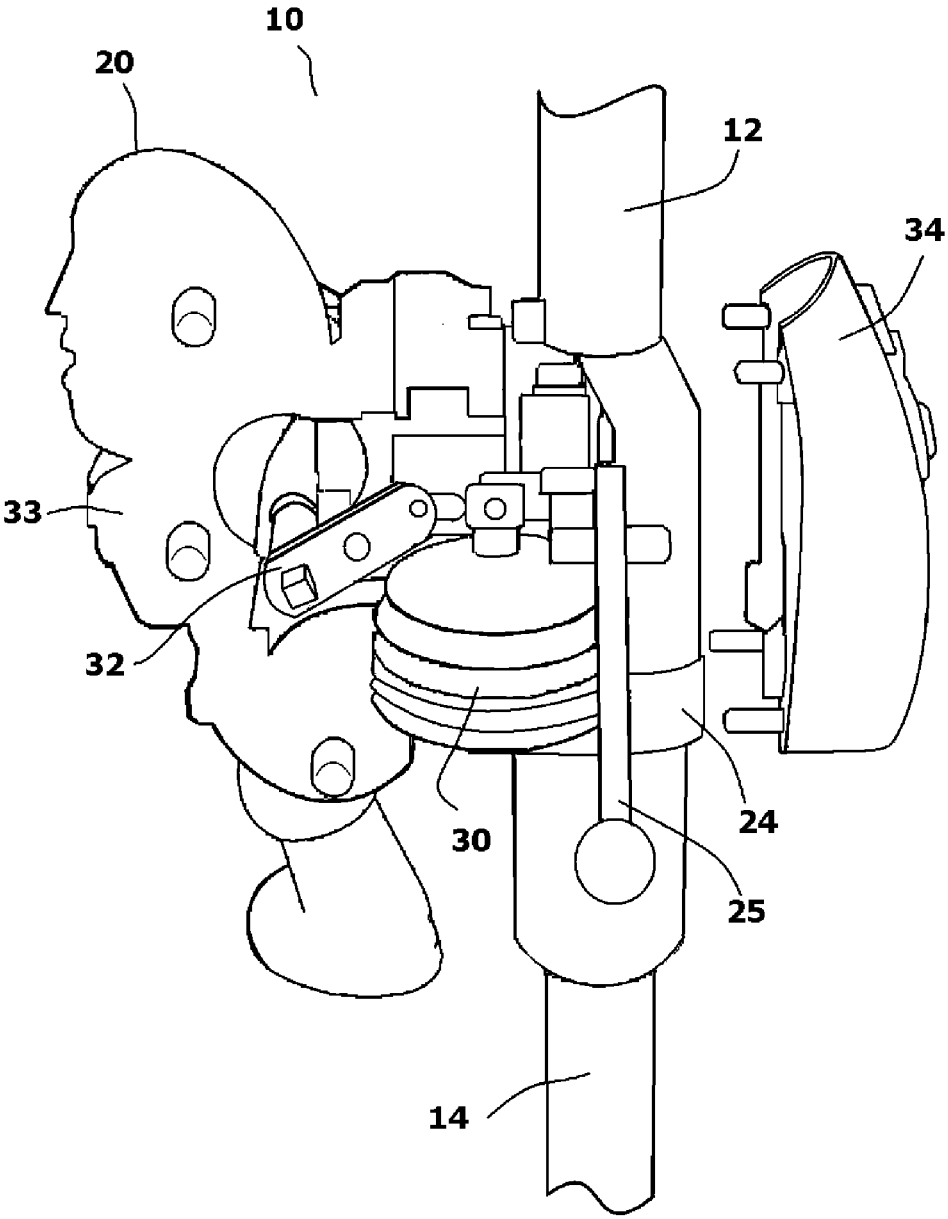
FIG. 3 is a partially exploded view of the articulated character shown in FIGS. 1 and 2.

Referring to FIG. 3, it can be seen that a manifold and diaphragm subassembly 24 is disposed between the upper straw section 12 and the lower straw section 14. The manifold and diaphragm subassembly 24 contains a bellows or corrugated diaphragm 30. The corrugated diaphragm 30 is made from an elastomeric material that biases the corrugated diaphragm 30 into its neutral molded shape. As a person draws liquid through the novelty straw assembly 10, the corrugated diaphragm 30 contracts. Once the suction stops, gravity pulls the liquid in the opposite direction. This causes the corrugated diaphragm 30 to expand back to its neutral molded shape. The reverse flow of the liquid can be supplemented by a slight blowing of the person using the upper straw section 12. As such, the corrugated diaphragm 30 acts as a piston that moves up and down. This movement of the corrugated diaphragm 30 is used to power one or more linkage assemblies 32.

The manifold and diaphragm subassembly 24, with its corrugated diaphragm 30, and the various linkage assemblies 32 it moves, are surrounded by the molded body segments 33, 34 of the articulated character 20. The moving parts 22 of the articulated character 20 are supported by the assemblage of the molded body segments 33, 34. Additionally, the moving parts 22 are engaged by elements of the various linkage assemblies 32. As such, the linkage assemblies 32 can cause movements in the moving parts 22.

Figure 4:
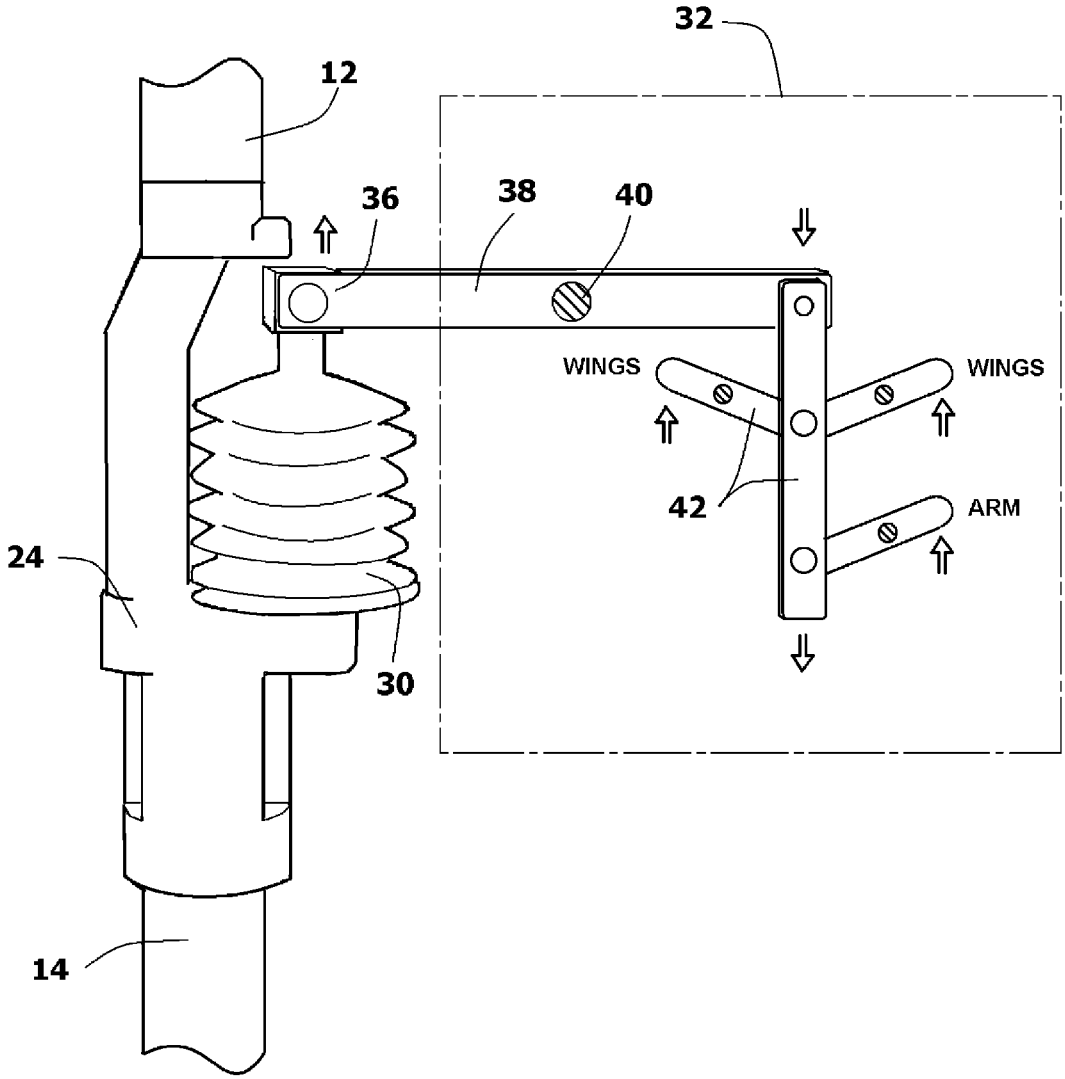
FIG. 4 is a schematic illustrating a simplified linkage assembly and its operation by a manifold and diaphragm subassembly, wherein the linkage assembly is oriented in a first configuration.
Figure 5:
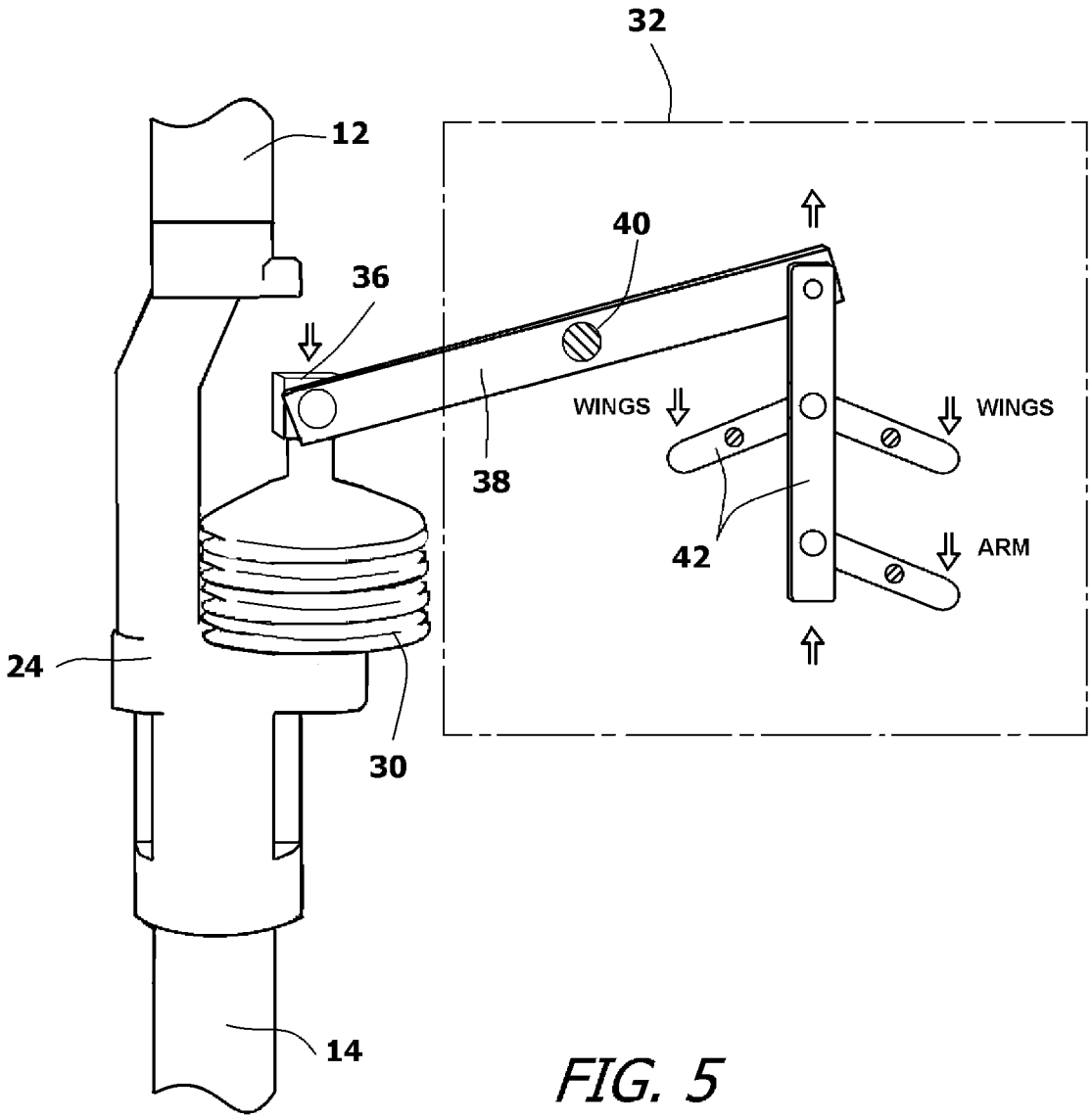
FIG. 5 is a schematic illustrating a simplified linkage assembly and its operation by a manifold and diaphragm subassembly, wherein the linkage assembly is oriented in a second configuration.

The linkage assemblies 32 can have many configurations. The configurations depend upon the size, location and desired range of motion for the moving parts 22. An exemplary simplification of the linkage assemblies 32 is shown in FIG. 4 and FIG. 5. Referring to FIG. 4 and FIG. 5, it can be seen that the corrugated diaphragm 30 can alter between a contracted condition and an expanded condition. As the corrugated diaphragm 30 moves between its expanded condition and the contracted position, a top mount 36 on the corrugated diaphragm 30 moves up and down. The top mount 36 is connected to one or more linkages 38. The linkages 38 pivot about a stationary pivot pin 40 that is part of the assemblage of molded body segments 33, 34 of the articulated character 20. The linkage 38 moves secondary linkages 42. The secondary linkages 42 are coupled to the moving parts 22 of the articulated character 20. As such, as the corrugated diaphragm 30 expands and contracts, the movement is transferred to the moving parts 22 through one or more linkages 38.

Figure 6:
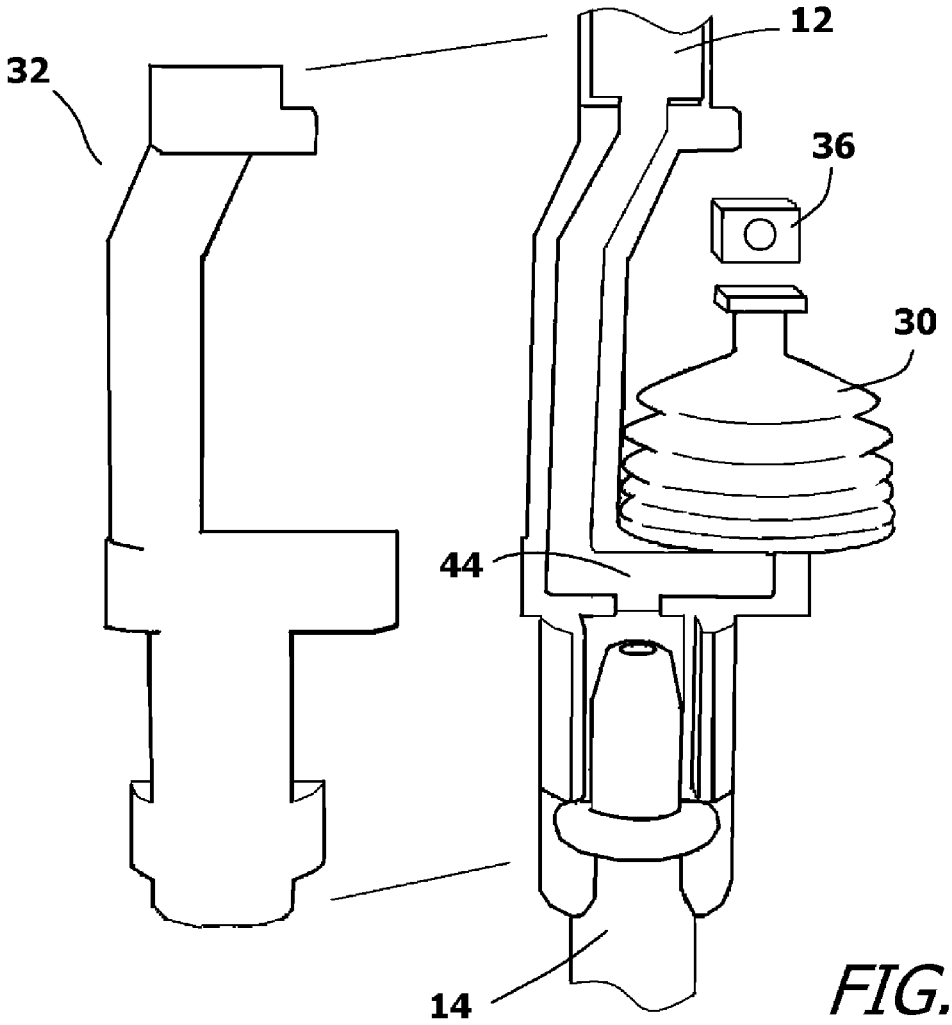
FIG. 6 is a cross-sectional view of the manifold that supports the diaphragm within the articulated character.

Referring to FIG. 6, the workings of the manifold and diaphragm subassembly 24 are now explained. As can be seen, the corrugated diaphragm 30 is mounted to a manifold 44. The lower straw section 14 and the upper straw section 12 are also affixed to the manifold 44. These straw sections 12, 14 can be made detachable from the manifold 44 for easy cleaning.

A person sucks upon the upper straw element 12 to draw liquid through the novelty straw assembly 10. This creates a low pressure within the manifold 44. The low pressure causes the corrugated diaphragm 30 to collapse. Thus, the top mount 36 of the corrugated diaphragm 30 moves down. Once any sucking stops, gravity pulls the liquid down within the novelty straw assembly 10 and the pressure within the manifold 18 becomes slightly greater than ambient pressure. The corrugated diaphragm 30 then expands. The expansion of the corrugated diaphragm 30 can be helped by slightly blowing the liquid downwardly in the upper straw section 12. The expansion of the corrugated diaphragm 30 moves the top mount 36 of the corrugated diaphragm 30 upwardly.

Figure 7:
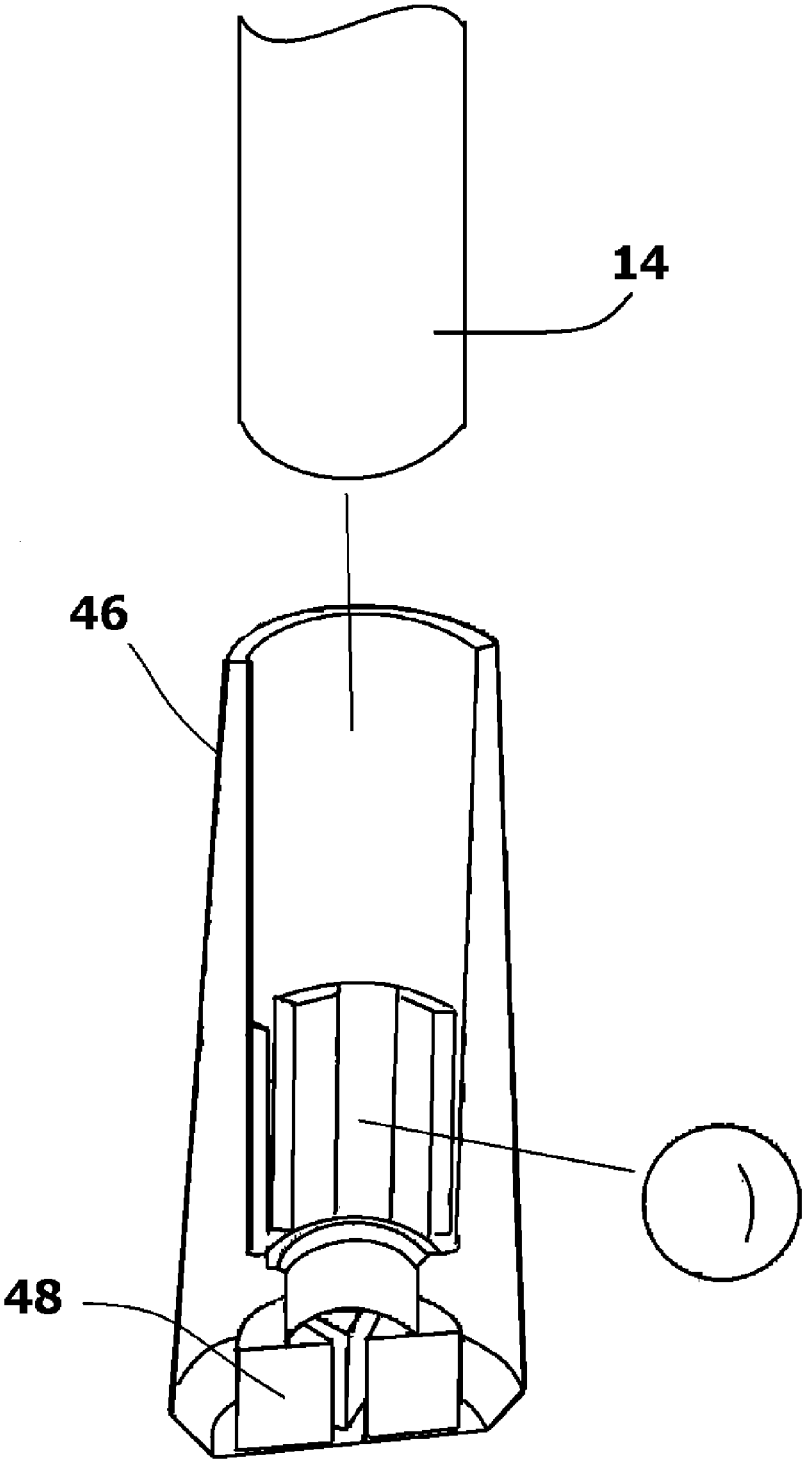
FIG. 7 is a cross-sectional view of a check valve at the base of the straw assembly.

Referring to FIG. 7, it can be seen that an intake head 46 is provided at the bottom of the lower straw section 14. The intake head 46 includes a filter 48 to prevent any large particles from being sucked into the novelty straw assembly 10 where they can adversely affect the operation of the manifold and diaphragm subassembly 24. The intake head 46 also serves as a restrictor that prevents a person from blowing too hard through the novelty straw assembly 10 which could cause the corrugated diaphragm 30 to over inflate or burst.

It will be understood that the embodiment of the present invention that is illustrated and described is merely exemplary and that a person skilled in the art can make many variations to that embodiment. All such embodiments are intended to be included within the scope of the present invention as defined by the appended claims.

What is claimed is:

1. A novelty straw assembly for drinking a fluid, comprising:

a first straw section;

a second straw section;

a diaphragm;

a manifold comprising a bottom opening, a top opening, and a side segment, said diaphragm mounted on said side segment, said side segment in fluid communication with the top opening and bottom opening through the manifold and having a fluid passageway that terminates in said diaphragm, wherein said manifold interconnects said first straw section to said second straw section so that said fluid passes through said manifold when flowing between said first straw section and said second straw section, therein creating changes in pressure within said manifold;

wherein said diaphragm expands and contracts with said changes in pressure within said manifold;

at least one linkage element that is moved by said diaphragm as said diaphragm expands and contracts; and a character having moving parts that are coupled to said at least one linkage element and are moved by said at least one linkage element.

2. The assembly according to claim 1, further including an intake head terminating said second straw element.

3. The assembly according to claim 2, wherein said intake head includes a filter.

4. The assembly according to claim 2, wherein said intake head includes a reverse flow restrictor for restricting flow through said second straw section from said manifold.

5. The assembly according to claim 1, wherein said character has molded body segments and wherein said diaphragm, said manifold and said at least one linkage element are all disposed within said molded body segments.

6. The assembly according to claim 1, wherein said character is disposed between said first straw section and said second straw section.

7. A novelty straw assembly for drinking a fluid, comprising:

a first straw section having a first end through which a person drinks said fluid;

a second straw section that leads into said first straw section, wherein said fluid causes changes in pressure in said first straw section as said fluid flows between said first straw section and said second straw section;

a manifold connected to the second straw section via a bottom opening, connected to the first straw segment via a top opening, and having a side segment;

a diaphragm mounted on said side segment, said side segment in fluid communication with the top opening and bottom opening through the manifold and having a fluid passageway that terminates in said diaphragm, wherein said diaphragm expands and contracts with said changes in pressure;

a mount coupled to said diaphragm, wherein said mount is moved by said diaphragm as said diaphragm expands and contracts;

linkages that are moved by said mount; and toy parts that are visibly mounted to said first straw section that are moved by said linkages.

8. The assembly according to claim 7, wherein said toy parts are part of a character that is mounted around said diaphragm and said linkages.

9. The assembly according to claim 7, further including an intake head terminating said second straw section.

10. The assembly according to claim 9, wherein said intake head includes a filter.

11. The assembly according to claim 7, wherein said intake head includes a reverse flow restrictor for restricting flow through said second straw section from said first straw section.

* * * * *